United States Patent [19]

Briggs

[11] 4,290,496

[45] Sep. 22, 1981

[54] COMBINATION IMPACT AND PRESSURE LIQUID ROCK DRILL

[76] Inventor: Aubrey C. Briggs, 3 Scheffield Dr., (Rosslyn Farms), Carnegie, Pa. 15106

[21] Appl. No.: 86,279

[22] Filed: Oct. 19, 1979

[51] Int. Cl.[3] ..... E21B 1/06

[52] U.S. Cl. ..... 175/321; 173/76

[58] Field of Search ..... 175/92, 321; 173/76, 173/80

[56] References Cited

U.S. PATENT DOCUMENTS 1,029,102 6/1912 Cazin ..... 173/76

1,698,343 1/1929 Mortimer et al. ..... 173/76

FOREIGN PATENT DOCUMENTS 613098 6/1978 U.S.S.R. ..... 173/76

*Primary Examiner*—James A. Leppink

*Attorney, Agent, or Firm*—Parmelee, Miller, Welsh & Kratz

[57] ABSTRACT

A conventional type of impact rock drill is modified to include a fluid reservoir, valve and piston arrangement whereby each impact stroke of the driver ejects water at high pressure from the cutter bit, thereby increasing the mechanical cutting through hydraulic action of a small volume of high pressure jet of water.

10 Claims, 6 Drawing Figures

COMBINATION IMPACT AND PRESSURE LIQUID ROCK DRILL

This invention relates to rock drilling tools and is for a unitary tool in which an impact type of cutter bit is combined with the discharge of water or other liquid at high pressure with each impact of the cutter bit against the rock surfaces.

Rock cutting and drilling tools of various kinds are well known and widely used wherein a chisel-like cutter bit is driven by successive blows against the rock surface, chipping away bits and fragments, with the successive and usually rapidly repeated impacts. Successful rock drilling has also been accomplished by projecting a stream of high pressure water or other liquid against the surface of the rock, but in addition to being quite slow, the volume of water so required makes it necessary to recover the water for reuse or to remove it from creating a nuisance in or around the work area. Considerable power is generally required for the operation of high pressure pumps for hydraulic drilling.

BRIEF DESCRIPTION OF THE PRESENT INVENTION

The present invention provides in a single tool an impact type of cutter where high pressure water or other liquid is discharged through the cutting bit in conjunction with the cutting stroke of the bit in such manner that the water, in relatively small quantities, penetrates cracks and crevices as the cutter is driven against the rock, increasing the rate of cutting or drilling and the overall efficiency of the tool and without requiring external pumps or pressure accumulators.

To this end the present invention combines a driver unit and a cutter unit axially aligned and connected for relative reciprocal movement and wherein the driver, acting through a limited lost motion connection with a piston operatively fitted into a cylinder in the cutter body, controls the flow of liquid into the cylinder and effects the discharge under high pressure of liquid from the cylinder through outlet ducts from the cylinder to the edge of a rock cutting bit portion of the cutter unit during and immediately following the instant of impact of said cutting edge with the surface of the rock being cut or drilled.

The invention may be more fully understood by reference to the accompanying drawings illustrating a preferred embodiment of a tool constructed in accordance with this invention, wherein.

Figure 1:
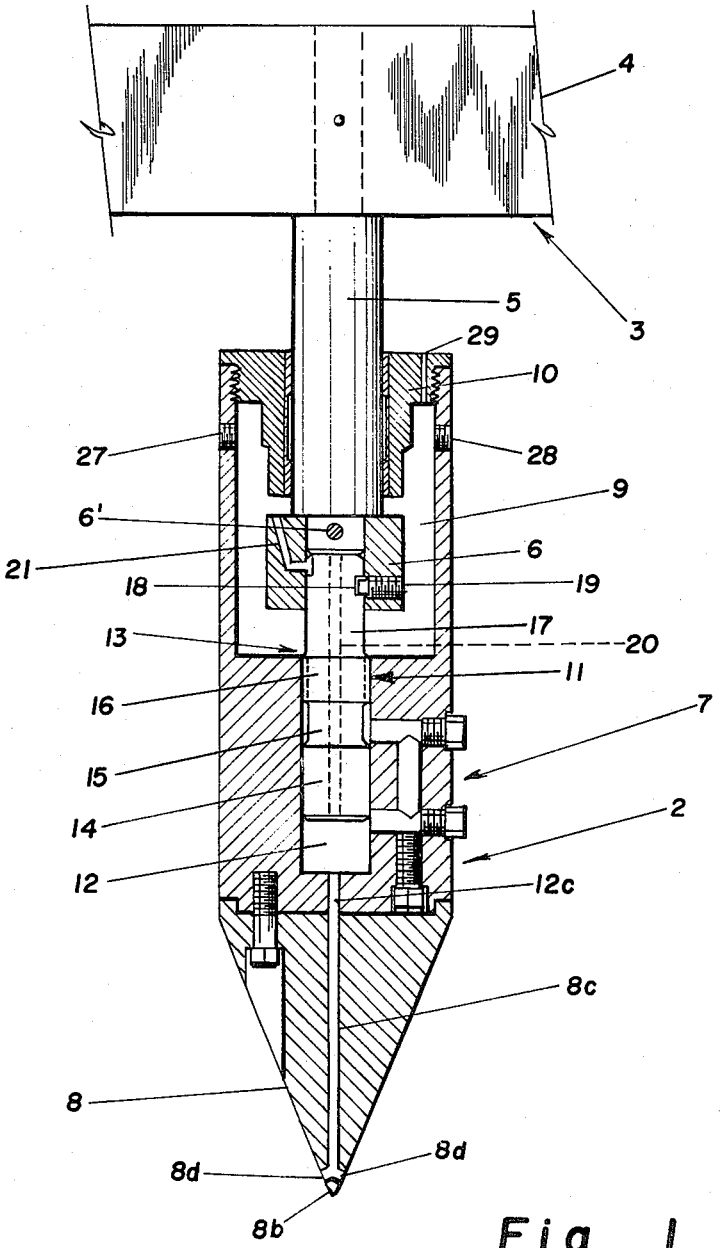
FIG. 1 is a longitudinal section through the drill with the axis of the drill vertical and certain elements are shown in elevation.

The assembly comprises two principal units, a cutter portion 2 and a driver unit 3 in axial alignment. They are connected for limited relative longitudinal movement with the cutter unit at the lower end of the driver.

The driver may be any usual power operated unit employed in impact operated rock drills, and is here indicated simply by the lower weighted portion 4 with a depending shaft 5. A collar 6 is fixed on the lower end of this extension, indicating that the pin 6' and collar 6 are fixed in relation to each other and to shaft 5.

The cutter unit comprises a generally cylindrical body 7 having a wedge or chisel-type cutting bit 8 secured to its lower end and having a chamber 9 in its upper end closed by a cap member 10 through the center of which the shaft 5 is slidably fitted. The collar 10, as shown, has a depending extension forming an abutment to limit relative upward travel of shaft 5 and collar 6 within the chamber 9. The cap 10 is screwed or otherwise fixed at the top of the chamber 9. The chamber 9, sometimes herein referred to as the upper chamber or reservoir, has a central bore 11 leading from the bottom down to a lower chamber 12, sometimes referred to as the pressure chamber or pressure cylinder.

There is a combination piston and valve member 13 slidably fitted in this bore. It has a piston element 14 slidably fitted in the cylinder. Above this there is a connecting portion 15 of reduced diameter above which there is an intermediate fluted guide element 16 slidably fitted into the bore. Above the guide element 16 the member 13 has an extension 17 of reduced uniform diameter extending upwardly and slidably fitted into the lower portion of the collar 6 on the driver. This uppermost end portion of the member 13 has an axially elongated notch 18 in its periphery. A radial keeper pin 19 in the collar 6 has a terminal that projects into this notch, thereby providing a limited lost motion connection between the lower end of the driver and the upper end of the piston and valve unit 13 whereby they may have relative axial movement with respect to each other. Both the driver and piston also have a limited axial movement relative to the cutter body 2. There is a relatively small diameter axial passage 20 extending through the member 13 from one end to the other. The top of the member 13 confronts the lower end of the depending shaft 5 of the driver and, when the piston member and collar slide relative to one another as permitted by the notch and keeper pin, 18 and 19 respectively, in one direction, these surfaces will come tightly together, providing a valving arrangement for closing the top of this passage. When they move relative to one another in the opposite direction, they open the space above 13*a* between them, thereby providing an open passage leading between a diagonal port 21 in the collar which opens into the reservoir 9 lengthwise of the member 13 into the high pressure chamber or cylinder 12, but the upper end of port 21 is closed when relative motion of the drive and cutter unit brings the upper end of port 21 tight against the lower end of the cap 10, which is during the driving stroke of the driver.

Figure 4:
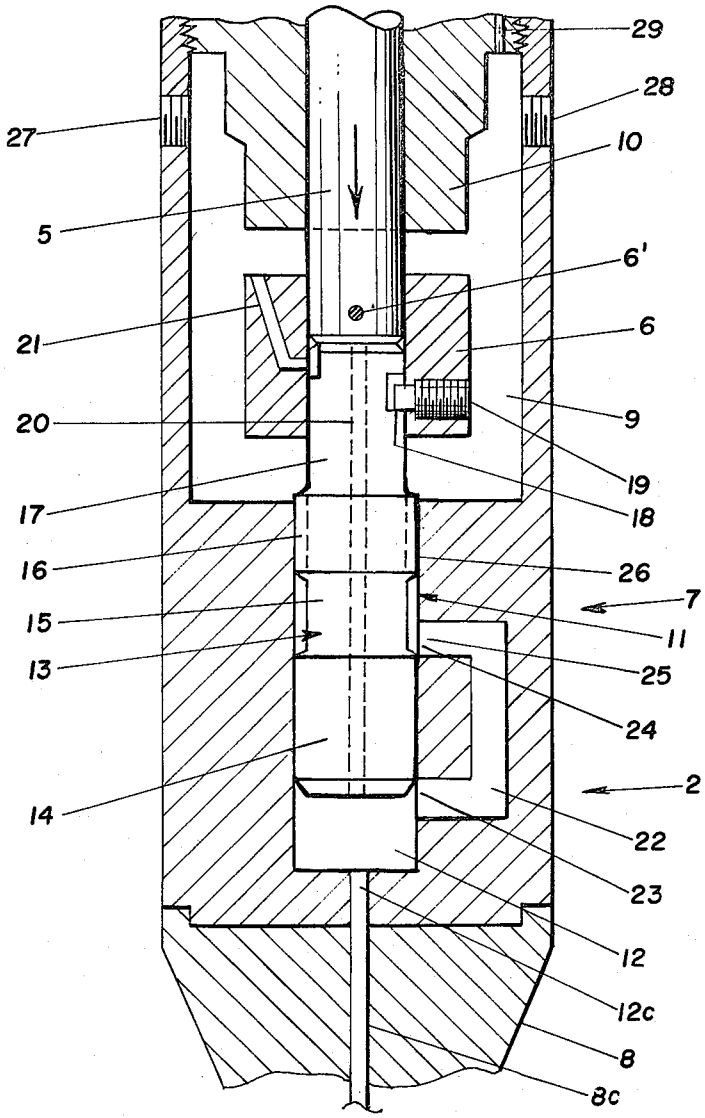
FIG. 4 is a view similar to FIG. 3 showing the relation of the parts after the drill has started toward the rock surface.

In the cylindrical body 7 of the cutter unit there is a bypass 22 having a lower port 23 that leads to the high pressure chamber or cylinder 12 and an upper port 24 that opens into the central bore 11 at an intermediate level about midway between the cylinder 12 and the upper chamber or reservoir 9. The piston element 14 is of a length where, near and at its uppermost limit of travel, it completely closes the upper port 24 (see FIG. 3) at which time lower port 23 is full open, but at or near its lowest point of travel, the lower port 23 is closed or blocked but the upper port 24 is open (see FIG. 5). In an intermediate position of the piston (see FIG. 4) the lower port 23 opens into the cylinder and the upper port 24 opens into the annular space 25 around the piston and valve member above the piston itself and below the guide portion 16. Guide portion 16 has axial channels or flutes 26 leading from the top of portion 16 at the lower end of extension 17 to the annular space 25.

There is an opening 27 in the side wall of the cylindrical body 7 near its upper end for the introduction into the reservoir of water or liquid, and there is an overflow outlet 28. There is also an air vent 29 in the cap member 10 so that atmospheric pressure will generally prevail in the reservoir.

Figure 2:
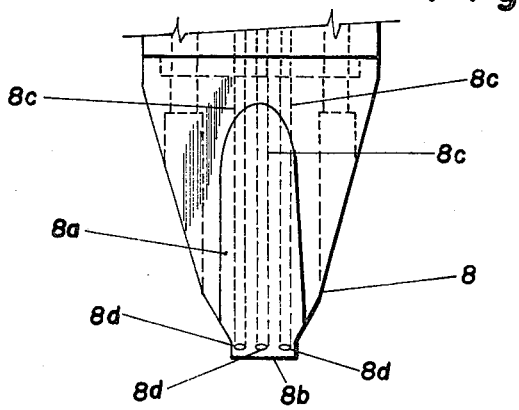
FIG. 2 is an elevation of the drill bit at right angles to the position shown in FIG. 1.

As shown in FIG. 2, the cutter bit 8, which is separable from the upper part of the unit, is generally in the shape of a wedge or an inverted cone, with flattened sides 8*a* terminating at the cutting edge 8*b*. There is at least one, and preferably a plurality (three being shown), of small diameter passages 8*c* leading through the bottom of the pressure cylinder and the length of the cutter bit 8 and which terminate in opposed discharge ports 8*d* in the side faces of the cutting edge of the bit. As shown in FIG. 1, the upper ends of the passages match with and form continuations of similar passages 12*c* in the bottom of the pressure cylinder 12.

Figure 3:
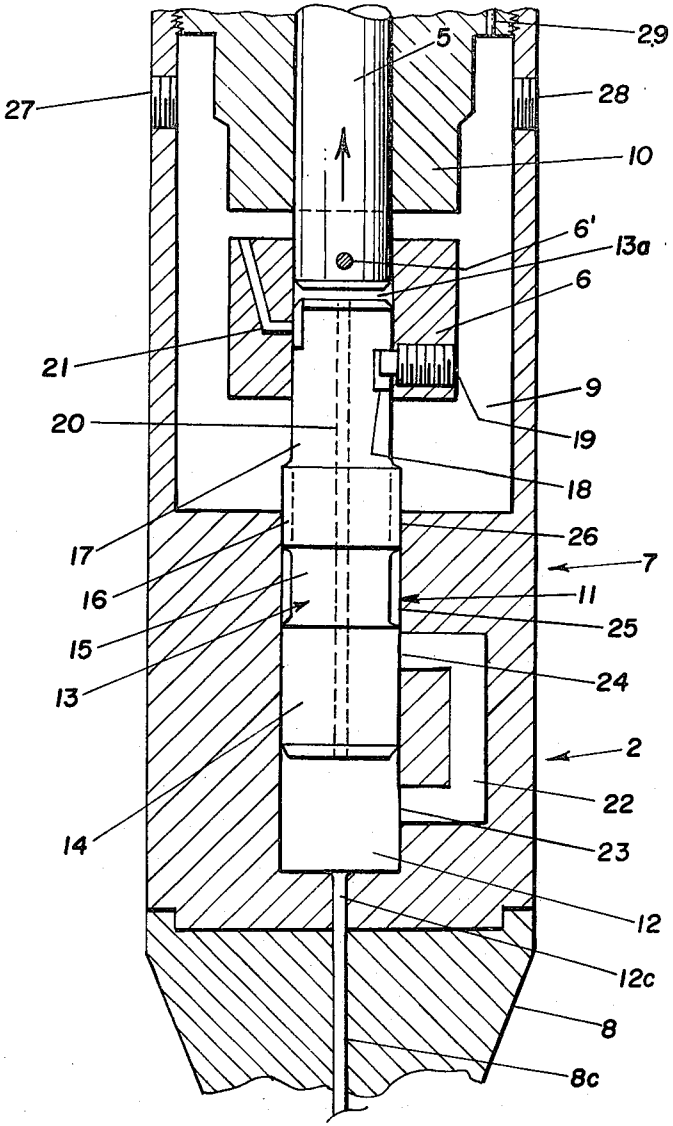
FIG. 3 is a fragmentary diagram on a larger scale than FIG. 1 showing the relation of the parts in the cutter section at an intermediate position where the driver nears the upper limit of its stroke away from the rock surface but has not fully reached the upper limit of its travel.

With the tool in operation and the driver on the upstroke between its upper and lower limits of travel, as shown in FIG. 3, the upwardly moving driver with its extension 5 and collar 6 having the keeper pin 19 at the upper limit of its travel in notch 18, will be then lifting the combination piston and valve member 13. Liquid may flow at this time from the reservoir through diagonal port 21 into the space above 13*a* down central passage 20 in the piston-valve unit 13 into the pressure chamber to keep the cylinder 12 filled and prevent suction of air back through passages 8*c*.

Reaching the upper limit of its travel (not shown), the diagonal port 21 is sealed by cap member 10 so that the liquid fill in the pressure chamber 12 is retained.

When the rock drill cutting bit 8 impacts upon the rock surface, the driver 5 and attached collar 6, continues to move in the direction of the rock surface due to its inertia while descent of the piston valve assembly is retarded by the liquid until the lower end of the driver shaft 5 closes against the top of extension 17 of the member 13, closing space 13*a* and closing the top of the axial passage 20. As the top of the piston uncovers the port 24, liquid may flow from the cylinder 12 through the bypass ports into the upper reservoir while at the same time flowing out the ends of the bit through the several restricted passages 12*c*–8*c*, but at this time only under fairly moderate pressure. The purpose of this arrangement is to delay the time at which the pressure chamber 12 is closed off and at which high pressure is developed until the point 8*b* of the cutting bit 8 has penetrated the rock to a depth that will cover the discharge ports 8*d* and, thereby, assure that the high pressure discharge will be directed against a solid surface of rock where it will be most effective.

Figure 6:
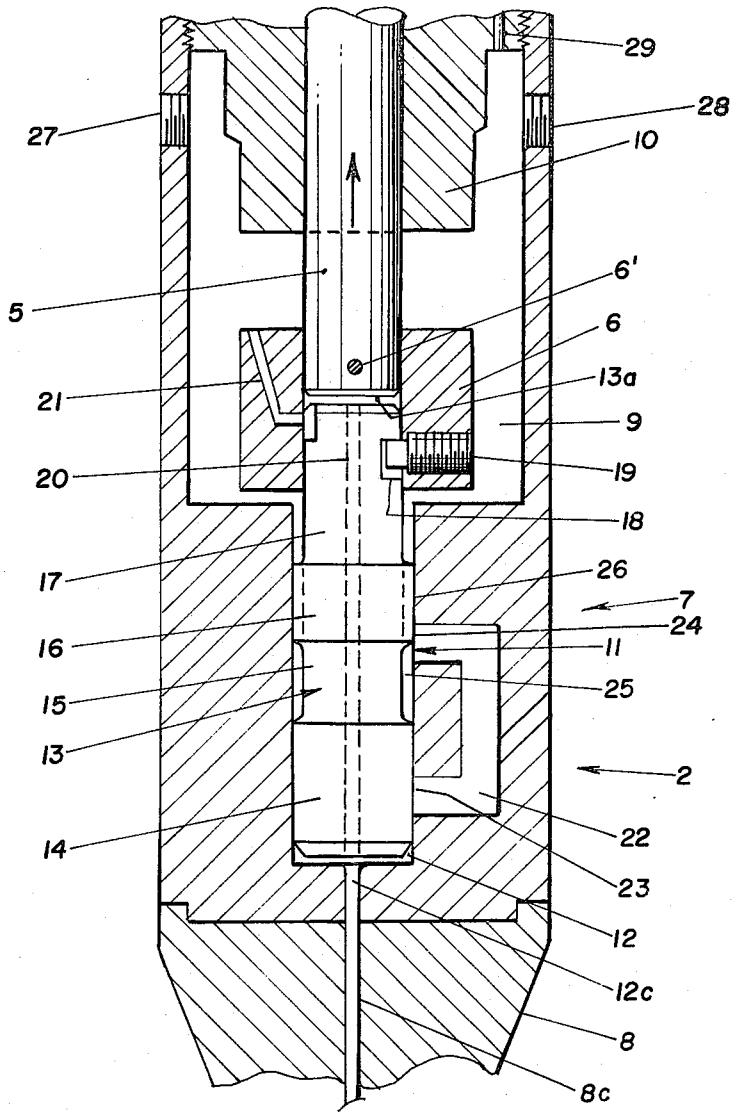
FIG. 6 is a view similar to the preceding figures but with the parts at the limit of the downstroke of the driver.
Figure 5:
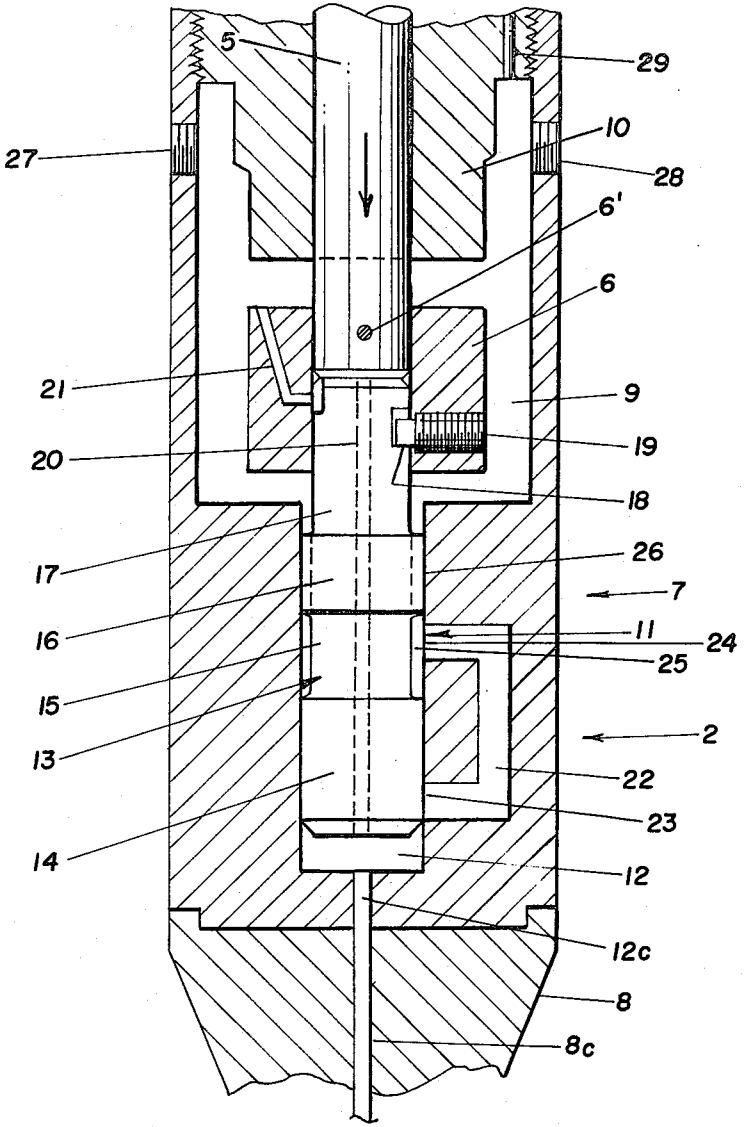
FIG. 5 is also a diagram showing the parts further along toward the limit of down travel than in the preceding figures.

As the collar 6 of the driver approaches close to the lower end of the chamber 9 to deliver the maximum impact to the cutter unit, the piston will close the lower bypass port 23, as shown in FIG. 5. At this point, the cutter 2 will be virtually motionless, having penetrated the rock surface while the inertial mass of the driver 5 and weight 4 will cause the driver to push with great force against the piston 13 and the water will then be forced from the cylinder under maximum high pressure through the passages 8*c* and out the ports 8*d* in the cutting end of the bit at the most effective time when the cutter is penetrating solid rock. Thereupon, the driver starts its upstroke to repeat the cycle as shown in FIG. 6. Since, at this instant, the driver shaft 5 moves up with relation to notch 18, the central passage 20 is again open at the top to refill the cylinder 12 and relieve any suction that might be created in the cylinder 12 that could suck any water or particles back into the cylinder.

Retracing the cycle, after the impact stroke and the driver starts its upstroke, a flow of liquid from the reservoir to the pressure chamber or cylinder is first established from the reservoir through diagonal port 21 and port 20 to keep a restricted flow of water into the pressure chamber 12 and outlet passages and incidentally prevent suction into the bit of water and debris. As the upper limit of travel is approached, piston 14 covers port 24, and this passage 21-20 is the only passage open between the reservoir and cylinder 12 (see FIG. 3). As the valve and piston unit starts down, port 24 uncovers and fluid flows from the reservoir around the fluted valve portion 16 and through port 25 into the pressure chamber to now be discharged under increasing pressure as the piston moves across port 23. Once port 23 is closed (FIG. 5) there is an instant when flow of air or water from above is cut off and any water in the cylinder is trapped. This is just as the maximum impact occurs and the water trapped in the chamber 12 and with the outlets of the passages in the bit partially obstructed, there is final timely high pressure discharge of water from the cutting edge.

The tool, as thus constructed, is relatively simple; little, if anything, need be added to its weight. There are no complications such as external pumps or disposal means and because of the relatively small volume of liquid discharged during each cycle.

I claim:

1. A rock drill comprising in combination means for cutting rock comprising a reciprocating impact driver having an axially extending shaft-like impact transmitting extension at its lower end and the cutter unit connected together through a lost motion connection with the said extension to allow limited relative axial movement between the driver and cutter unit, the cutter unit having a cutting bit extending axially from its free end, a liquid holding reservoir in the cutter unit, a pressure cylinder in the cutter unit, and combined valve and piston means operated by said relative movement between the driver and cutter unit for forcing water from the pressure cylinder through the cutter bit during the impact stroke of the driver arranged to transfer liquid from said reservoir to the high pressure cylinder on the succeeding reverse stroke of the driver.

2. A rock drill as defined in claim 1 wherein said valve and piston means has a limited relative movement to both the cutter unit and the driver, and valving means arranged through said last named means effective to break any suction from the end of the cutter bit back into the pressure chamber on the upstroke of the cutter unit and driver.

3. A rock drill as defined in claim 2 wherein there is a liquid retaining reservoir in the cutter unit and said valving means is arranged to bypass liquid from the reservoir to the pressure chamber sufficient to continue a discharge of flushing water from the bit during its upstroke.

4. A rock drill comprising:

(a) a driver unit and a cutter unit slidably connected in axial alignment for relative axial movement;

(b) the cutter unit comprising a generally cylindrical body with a reservoir in its upper end, an axial bore and pressure cylinder intermediate its ends and a cutter bit at its opposite end terminating in a cutting edge;

(c) the driver unit having a cylindrical extension arranged to be moved up and down with its lower end slidably entered through the upper end of the cutter unit into said reservoir and having a collar at its lower end;

(d) a combined piston and valve member received in said axial bore of the cylindrical body with a piston element at its lower end operably fitted in the pressure cylinder and having an extension at its upper end, there being a lost motion connection between said extension and the lower end and collar of the driver arrangement to limit relative axial movement between the driver and the piston to a lesser extent than the relative sliding movement provided between the cutter unit and the driver unit;

(e) water discharge duct means leading from the cylinder to discharge ports in the cutting edge of the bit;

(f) the cylindrical body and the piston and valve member having passages and ports arranged to effect the transfer of water from the reservoir to the cylinder on the upstroke of the driver relative to the cutter unit and to forcibly expel the water from said cylinder on the downstroke of the driver out through said duct means from the cylinder.

5. A rock drill as defined in claim 4 in which the combination piston and valve is so connected with the driver and the ports and passages are so arranged that the discharge of the water being expelled from discharge ports is momentarily stayed and to be expelled at high pressure with the final increment of downstroke of the driver.

6. A rock drill as defined in claim 5 wherein the lost motion connection between the extension on the upper end of the piston and valve member with the lower end and collar of the driver piston and valve member to complete it travel in the cylinder for expelling water therefrom to continue by its inertia after the driver and cutter unit have been stopped in their downstroke by impact with the rock being drilled to complete the pressure discharge of water from the cylinder and cutter bit.

7. The rock drill defined in claim 4 wherein the combined piston and valve member has a longitudinal passage therethrough which, by reason of the lost motion connection between the driver and the combined piston and valve member, is arranged to be closed by said cylindrical extension on the driver when the driver is moving the piston down relative to the cutter unit but to continue a restricted flow of water from the reservoir to the pressure cylinder and simultaneously prevent suction of the water through the cutter bit back into the cylinder.

8. An impact rock cutting tool comprising:

(a) a reciprocable driver unit having an up and down stroke and a cutter unit;

(b) means comprising a lost motion connection joining the two units in end-to-end relation for relative axial movement;

(c) the cutter unit having a tool bit with a cutting edge portion at the end of the unit remote from said means connecting the two units, the cutter unit having a pressure chamber therein with duct means leading therefrom and opening through the cutting end portion of the bit through which liquid may be discharged from the pressure chamber to the rock being cut;

(d) a reservoir for liquid in the cutter unit;

(e) passage means in the cutter unit connecting the reservoir and the pressure chamber for the transfer of liquid from the reservoir to the pressure chamber;

(f) a combination piston and valve member in the cutter unit movable axially of the cutter unit and having a piston in the pressure chamber and valve portions arranged to cooperate with said passage means to open the passage means to the transfer of liquid from the reservoir to the pressure chamber during a portion of the axial travel of said member relative to the cutter unit in which it is contained and block said flow near the upper and lower limits of travel of said member relative to the cutter unit;

(g) means providing a second lost motion connection between the driver and said combined piston and valve member whereby limited relative travel in an axial direction may occur between the driver and combined piston and valve member upon close approach and at the instant of impact of the cutter bit with the rock being drilled to eject water under pressure from the pressure chamber through the bit and to break the suction and establish a restricted flow of water from the reservoir into the pressure chamber on the upstroke of the driver following such impact;

(h) the driver and cutting unit each having cooperating elements to limit the relative axial movement thereof to a distance less than the full stroke of the driver whereby the cutter unit will be forced against the rock surface being drilled by sudden impact as the driver nears the lower limit of its downstroke.

9. An impact rock cutting drill as defined in claim 8 wherein the driver unit has a depending extension with a collar at its lower end and there is a cap fixed to the top of the reservoir in which the extension of the collar has a sliding fit but through which the collar cannot pass, whereby the cutter unit is lifted with the driver near the upper limit of travel of the driver, the bottom of the reservoir limiting relative axial movement of the driver and cutter unit in the opposite direction, the arrangement being such as to deliver a sharp impact of cutter bit against the rock being drilled as the driver reaches the lower limit of its stroke and is lifted away from the rock surface near the upper limit of the stroke of the driver.

10. An impact rock cutting tool comprising a driver member and a cutter member, including:

(a) means providing a first lost motion connecting joining the two members in end-to-end relation for relative axial movement;

(b) the cutter member having a tool bit portion having a cutting edge at the end opposite its connection with the driver and also having a pressure chamber therein with a passage leading from the pressure chamber to the cutting edge of the tool bit;

(c) a reservoir within the cutter member, the driver having an axial extension slidably passing through the cutter member into the reservoir to provide said first lost motion connection with a bottom and side walls which hold a supply of liquid with the tool; and a combined valve and piston member mounted within the cutter member for axial movement relative thereto and having a lost motion connection inside the reservoir with the driver member and which constitutes a second lost motion connection arranged to change the position of the combined piston and valve member relative to both the cutter member and the driver unit with each alternate up and down stroke of the driver, the piston having an axial passage therethrough between the reservoir and the pressure chamber with said second lost motion connection providing a valve for said axial passageway that is open between the reservoir and said axial passage upon upstroke of the driver and which closes upon impact of the cutter with the surface being cut to expell liquid from the pressure chamber by the closing of said axial passage that occur with the sudden impact of the cutter unit the rock being drilled effected through said first lost motion connection and the lesser relative movement between the driver and piston member when the down travel of cutter unit is stopped but with the piston then moving down under the force of the driver to expel liquid from the pressure chambers.

* * * * *

UNITED STATES PATENT OFFICE

CERTIFICATE OF CORRECTION

PATENT NO. : 4,290,496

DATED : September 22, 1981

INVENTOR(S) : Aubrey C. Briggs

It is certified that error appears in the above-identified patent and that said Letters Patent are hereby corrected as shown below:

On The Title Page, the following should be inserted.

-- (73) Assignee: Dravo Corporation
Pittsburgh, Pennsylvania --.

Signed and Sealed this

*Nineteenth* Day of *January 1982*

[SEAL]

*Attest:*

GERALD J. MOSSINGHOFF

*Attesting Officer*

*Commissioner of Patents and Trademarks*